US006070962A

United States Patent [19]

Kinoshita

[11] Patent Number: 6,070,962

[45] Date of Patent: Jun. 6, 2000

[54] HANDHELD DOT PRINTING DEVICE

[75] Inventor: Naohisa Kinoshita, Nagoya, Japan

[73] Assignee: Brother Kogyo Kabushiki Kaisha, Nagoya, Japan

[21] Appl. No.: 08/749,244

[22] Filed: Nov. 14, 1996

[30] Foreign Application Priority Data

Nov. 17, 1995 [JP] Japan ..... 7-323820

[51] Int. Cl.[7] ..... B41J 2/145; B41J 2/15; B41J 29/38; B41J 29/393

[52] U.S. Cl. ..... 347/40; 347/14; 347/19

[58] Field of Search ..... 347/40, 109, 12, 347/33, 19, 3, 14; 346/143

[56] References Cited

U.S. PATENT DOCUMENTS

| | | | |
|---|---|---|---|
| 4,325,086 | 4/1982 | Sato et al. | 347/3 |
| 4,777,609 | 10/1988 | Cavill et al. | 364/519 |
| 4,915,027 | 4/1990 | Ishibashi et al. | 347/222 |
| 5,240,334 | 8/1993 | Epstein et al. | 346/143 |
| 5,297,017 | 3/1994 | Haselby et al. | 347/19 |
| 5,634,730 | 6/1997 | Bobry | 346/143 |

FOREIGN PATENT DOCUMENTS 48-17630 3/1973 Japan .

*Primary Examiner*—N. Le
*Assistant Examiner*—Thinh Nguyen
*Attorney, Agent, or Firm*—Oliff & Berridge, PLC

[57] ABSTRACT

A portable dot printing device including an encoder for detecting movement amount of the portable dot printing device across the recording medium and for producing a pulse signal based on a minimum movement amount detectable by the encoder; and a print head formed with at least a first element row and a second element row each having elements for printing dots on the recording medium, the first element row and the second element row being separated by a predetermined pitch equal to a multiple of the minimum movement amount, the print head being controlled to print images using the elements based on the pulse signal from the encoder.

22 Claims, 4 Drawing Sheets

HANDHELD DOT PRINTING DEVICE

BACKGROUND OF THE INVENTION

1. Field of the Invention

The present invention relates to a portable dot printing device for printing dots on printing mediums, such as printing sheets.

2. Description of the Related Art

Japanese Patent Application (Kokai) No. 48-17630 describes a manual dot printing device capable of printing at a desired position on a printing medium when manually scanned across the printing medium. The manual printing device is capable of printing on various printing mediums regardless of the size or the thickness of the printing medium, thereby overcoming a limitation of other printing devices capable of printing on only certain sized recording mediums by limitations of their casing size or their sheet-transport mechanisms.

To print characters on a printing medium with greater precision and at a higher density, the relative movement of the print head across the printing medium has to be precisely detected by an encoder of the device. Generally, the relative movement of a print head across the printing medium is detected by a pulse waveform. The print head can be formed with nozzles aligned in rows. When the minimum unit of movement detectable by the encoder, or one pulse, is not equal to the distance between adjacent nozzle rows formed in the print head, even if the movement amount of the print head is detected precisely, the rows of the nozzles cannot precisely print based on the print head movement.

SUMMARY OF THE INVENTION

It is an objective of the present invention to overcome the above-described problem and to provide a portable dot printing device having a print head formed with a plurality of nozzle rows and capable of precise printing.

In order to achieve the above-described objectives, a portable dot printing device according to the present invention includes an encoder for detecting movement amount of the portable dot printing device across the recording medium and for producing a pulse signal based on a minimum movement amount detectable by the encoder; and a print head formed with at least a first element row and a second element row each having elements for printing dots on the recording medium, the first element row and the second element row being separated by a predetermined pitch equal to a multiple of the minimum movement amount, the print head being controlled to print images using the elements based on the pulse signal from the encoder.

With this configuration an interval between the nozzle rows in the print head is a multiple of the minimum movement amount of the print head over the printing medium detectable by the encoder. Therefore, the same portion of printing area can be printed consecutively by more than one row of nozzles.

According to another aspect of the present invention, the distance between adjacent nozzle rows in the print head is equal to a multiple of an angular interval between slits in a slit disk of the encoder. Therefore, the encoder can precisely detect the exact position to be printed on by the row of nozzles in the print head.

According to still another aspect of the present invention, the nozzle rows include a first row of odd-number nozzles and a second row of even-number nozzles. The nozzles in the first row and nozzles in the second row are shifted out of alignment from each other in a direction in which the nozzle rows extend. Therefore, more dense characters can be printed.

A method according to the present invention for controlling a portable dot printing device for printing dot images on a recording medium, includes the steps of: detecting with an encoder movement amount of the portable dot printing device across the recording medium; producing a pulse signal based on a minimum movement amount detectable by the encoder; and controlling a print head, which is formed with at least a first element row and a second element row each having elements for printing dots on the recording medium, wherein the first element row and the second element row are separated by a predetermined pitch equal to a multiple of the minimum movement amount, to print images using the elements based on the pulse signal.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
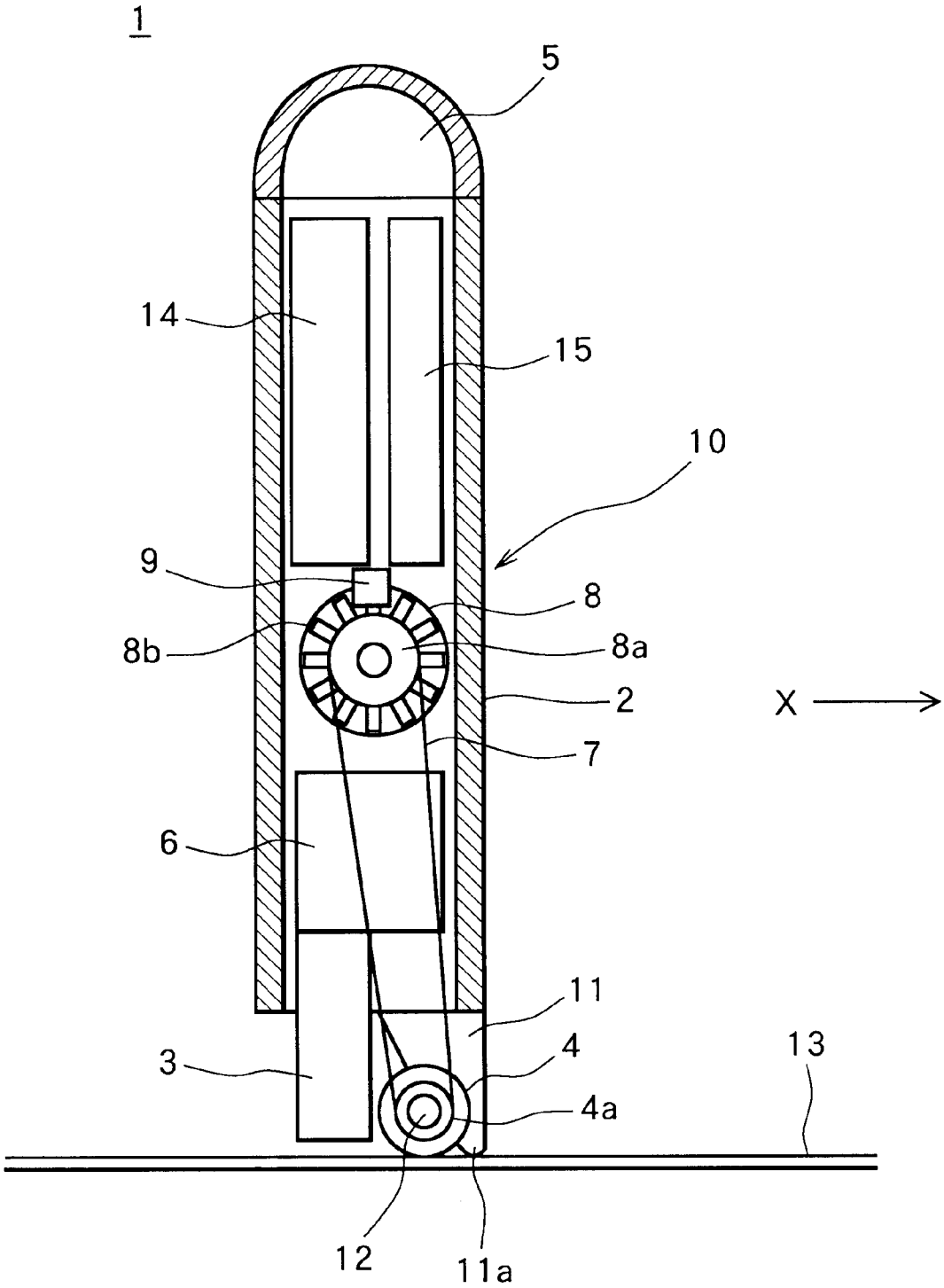
FIG. 1 is a cross-sectional view showing a portable dot printing device according to an embodiment of the present invention.

A portable dot printing device according to a preferred embodiment of the present invention will be described while referring to the accompanying drawings wherein like parts and components are designated by the same reference numerals to avoid duplicating description.

FIG. 1 is a plan view schematically showing a portable dot printing device 1 according to the present embodiment of the present invention. The portable printing device 1 is capable of printing characters and symbols on a recording medium when manually scanned across the surface of the recording medium in a scanning direction indicated by an arrow X in FIG. 1. A hollow casing has disposed at its upper end an infrared data transmission portion 5 for transmitting and receiving a variety of data, such as print data, between an external device (not shown in the drawings) and the portable dot printing device. The hollow casing has disposed at its lower end an ink jet head 3 for printing by ejecting ink droplets onto a printing paper 13, which serves as a printing medium; a roller 4 for rolling across the surface of the sheet 13 to detect the relative speed, that is, the amount of the movement, of the portable dot printing device 1 over the printing sheet in the scanning direction X in order to print at desired locations on the recording sheet 13; and an ink tank 6 for supplying ink to the ink jet head 3 is provided within the portable dot printing device 1 at a position above the ink jet head 3. Although not shown in the drawings, also, a switch for turning a power source on and off and for selecting one of a variety of modes, such as a print start mode, is provided to the side of the casing 2.

Figure 2:
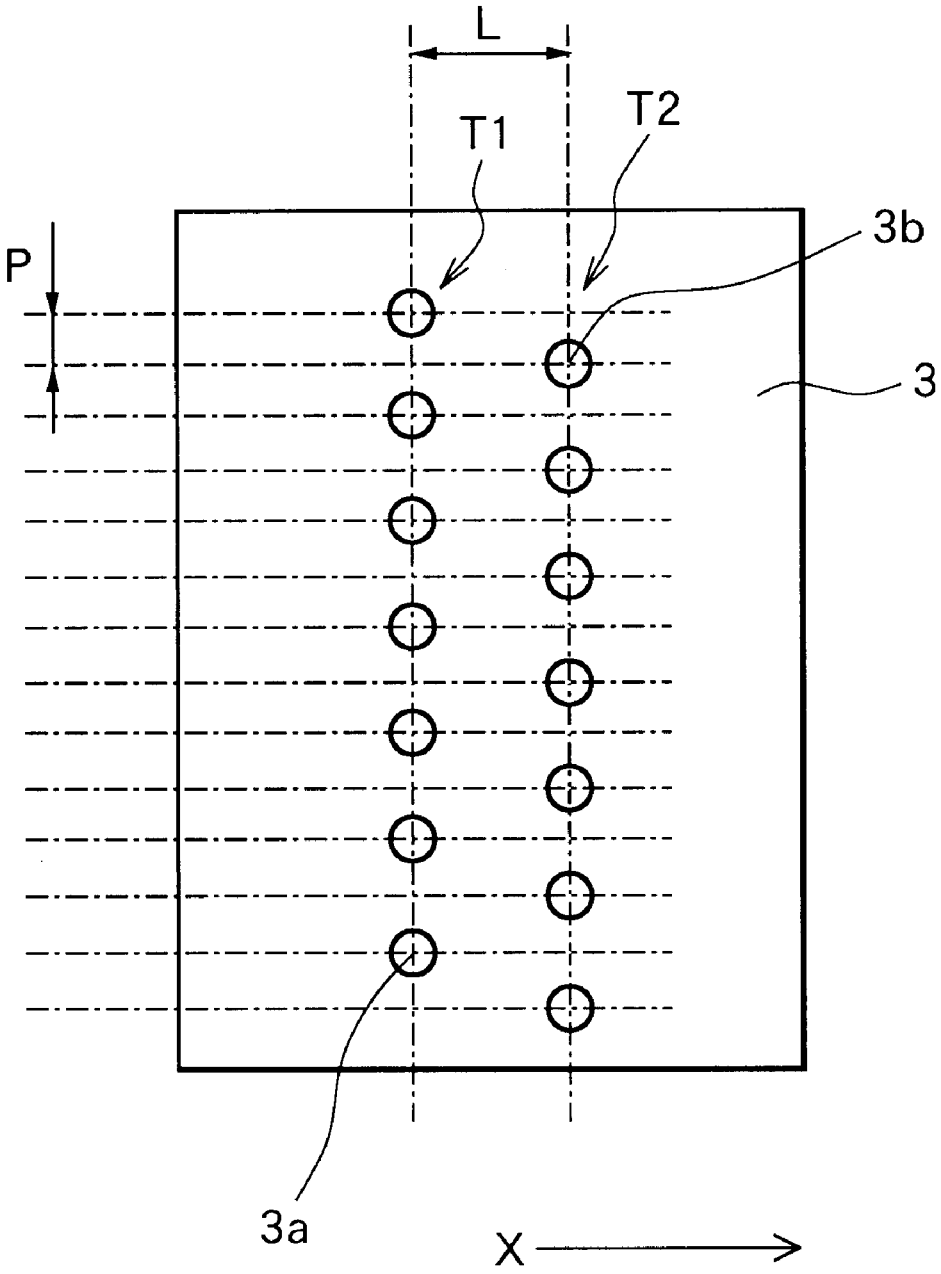
FIG. 2 is a plan view showing arrangement of nozzle rows in a pint of the portable dot printing device.

The ink jet head 3 is for printing dot pattern formed with dot rows of 14 dots each. As shown in detail in FIG. 2, each nozzle row of the print head 3 includes a first nozzle row T1 and a second nozzle row T2. The first nozzle row T1 includes nozzles 3*a*, which correspond to odd-number dots of dot patterns, and the second nozzle row T2 includes nozzles 3*b*, which correspond to even-number dots of dot patterns. The nozzles 3*a* and 3*b* in the first and second nozzle rows T1, T2 are arranged in a staggered pattern. Said differently, the nozzles 3*a* are shifted with respect to the nozzles 3*b* in a direction in which the nozzle rows T1 and T2 are aligned, which is perpendicular to the scanning direction X. Adjacent nozzles 3*a* and 3*b* are separated by a uniform nozzle pitch P in the direction in which the nozzle rows extend. The first nozzle row T1 and the second nozzle row T2 are separated by a nozzle row pitch L in the scanning direction X.

Turning back to FIG. 1, a pulley 4*a* is integrally formed on the roller 4. A slit disk 8 having a disk timing belt pulley 8*a* is rotatably supported above the ink tank 6. The roller timing belt pulley 4*a* is connected to the disk timing belt pulley 8*a* by a timing belt 7 so that rotation of the roller 4 is transmitted to the slit disk 8. The slit disk 8 is formed with a plurality of radially extending slits 8 *b* disposed at an equiangular interval. In other words, all adjacent slits 8*b* of the plurality of slits 8*b* are oriented at the same angle to each other and are separated by the same distance. A photointerupter 9 for emitting light and detecting any light passing through the slits is provided in connection with the slit disk 8. The slit disk 8 and the photointerupter 9 configure an encoder 10 for detecting the rotation of the roller 4, that is, the amount of the movement of the portable dot printing device 1, and outputting a pulse signal accordingly.

The nozzle row pitch L is set to correspond to a multiple of the smallest unit of movement amount of the ink Jet head 3 over the printing sheet 13 detectable by the encoder 10. In the present embodiment, the nozzle row pitch L is set to correspond to a multiple of the equiangular interval between adjacent slits 8*b* in the slit plate 8.

The control unit 14 receives the signal from the encoder 10 and, based on the movement amount of the ink jet head 3 and previously stored print data, drives and controls the ink Jet head 3 through the head driver 15 to print characters on the printing sheet 13.

A roller holder plate 11 provided on the lower end of the casing 2 rotatably supports the roller 4 adjacent to the print head 3. A lower portion 11*a* is formed to the roller holder plate 11 from a resin or other material with good sliding characteristics with respect to the printing sheet In order to print according to print data, inputted from an external device for example, a user grasps the casing 2 by hand and places it on the recording medium 13, such as a paper sheet. The user then scans the casing 2 in the scanning direction across the surface of the recording medium 13 while maintaining the roller 4 and the lower portion 11*a* in contact with the upper surface of the recording medium 13. While the user scans the casing 2 across the sheet, the print head 3 ejects ink droplets according to the print data so that a predetermined printing pattern can be printed on the surface of the recording medium 13. During printing, the roller 4 and the lower portion 11*a* maintain the upright orientation of the body 1 and fix the distance from the surface of the print medium 30 to the ink jet print head 5.

Figure 3:
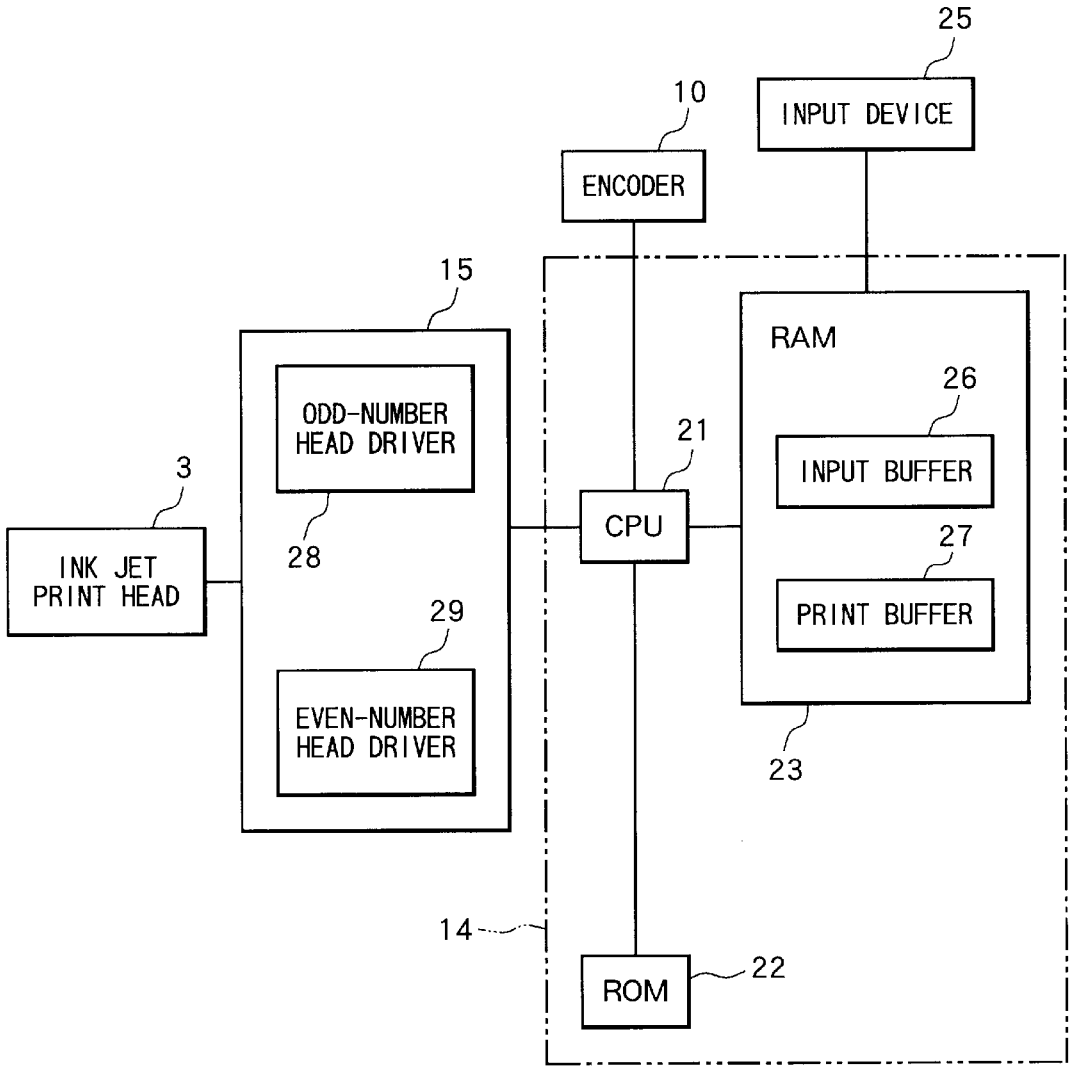
FIG. 3 a block view showing configuration of a control system of the portable dot printing device.

As shown in FIG. 3, the control portion 14 includes a CPU 21, a ROM 22 storing a control program, and a RAM 23 for storing print data. The CPU 21 is inputted with the signal from the encoder 10 and drives the head driver 15 based on the control program stored in ROM 22 and the print data stored in RAM 23 so that the ink jet head 3 prints on the printing sheet 13.

The RAM 23 is provided with an input buffer 26 and a print buffer 27. Dot pattern data for printing a few lines is input to the RAM 23 from an input device 25 and stored in the input buffer 26. Dot pattern data for printing one line is stored in the print buffer 27. The head driver 15 includes an odd-number head driver 28 for controlling ink ejection from the odd-number nozzles 3*a* in the first row T1 and an even-number head driver 29 for controlling ink ejection from the even-number nozzles 3*b* in the second row T2.

Figure 4:
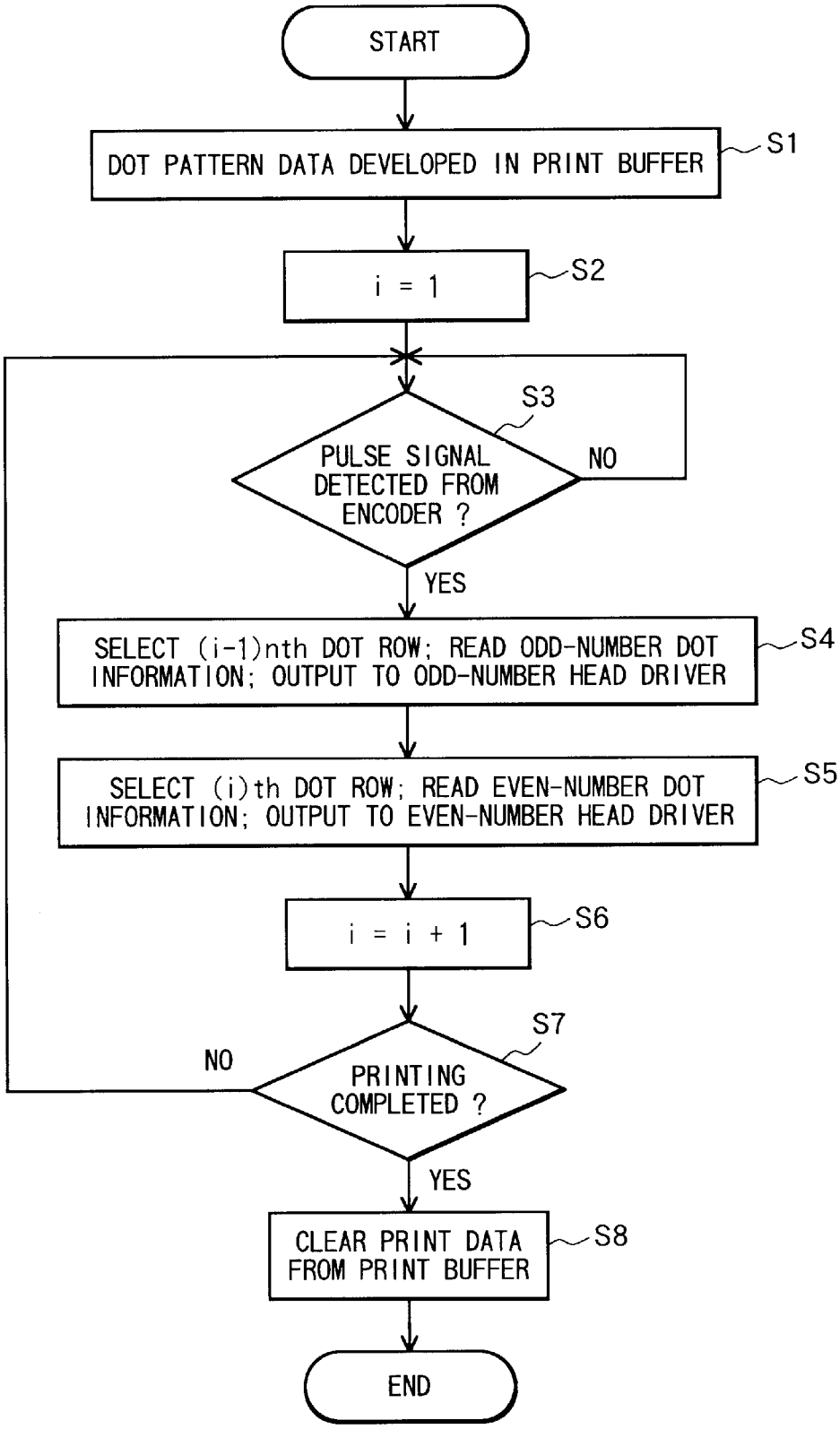
FIG. 4 is a flowchart representing a routine for controlling operations of the portable dot printing device.

Next, a routine for controlling printing operations of the portable dot printing device will be described while referring to the flowchart in FIG. 4. In this example, it will be assumed that a character mode has been selected and that character code data has been inputted into the input buffer 26 accordingly. It will also assumed that dot pattern data of each character is read from a character generator in response to a start signal and then developed in the print buffer 27.

At the start of this routine, first the dot pattern is developed in the print buffer 27 in S1. Then, in S2 a dot row counter (i) is set to 1. Next, whether or not a pulse signal from the encoder 10 is detected is determined in S3. Detection of a pulse signal from the encoder 10 indicates that printing is necessary, so the routine will proceed to S4. On the other hand, when no pulse signal from the encoder 10 is detected, indicating that printing is not yet required, then, S3 is repeated until a pulse signal is detected.

In S4, data for the odd-number dots of a (i−1)nth dot row is selected from the print buffer 27. On/off information is read from the data and sent to the head driver 28. Consecutively with this, in S5 data for even-number dots of the (i)th dot row, which is to be printed subsequent to the (i−1)nth dot row, is selected from the print buffer 27. On/off information is read from the data and sent to the head driver 29. Next in S6, the ink jet print head simultaneously prints the odd number dots of the (i−1)th dot row using the nozzles 3*a* of the first row T1 and the even number dots of the (i)th row using the nozzles 3b of the second row T2 based on the on/off data. Also in S6, the counter (i) is incremented by 1 (i.e., i+1).

In S7 the control portion determines whether or not the present printing job has been completed for all dot rows. If so (S7:YES), then in S8 dot pattern data is cleared from the print buffer 27 and this routine is ended. If the present job has not been completed (S7:NO), then the routine returns to S3 and repeats S3 through S7. In this case, when detection of a pulse signal is determined in S3, this means that printing device 1 has been scanned the nozzle row pitch L in the scanning direction X so that the nozzles 3*b* of the second row T2 are aligned with the dot row previously printed by the nozzles 3*a* of the first row T1. Therefore, in S4 the nozzles 3*b* of the second row T2 will print the even dots corresponding to the odd dots previously printed by the nozzles 3*a* of the first row T1. It should be noted that the determination of S7 is performed based on whether dot pattern data remains in the print buffer 27.

As described above, for each dot row of a dot pattern, the routine first prints odd-number dots in the first cycle using the nozzles 3*a* of the first row T1 of the ink jet head 3 and then prints even-number dots in a subsequent cycle using the nozzles 3*b* of the second row T2 of the ink jet head 3.

When the line pitch for printing is set to a distance equal to a minimum movement amount, which is the smallest amount of movement of the print head 3 over the print medium 3 detectable by the encoder 1, multiplied be an integral number n, then printing is easily performed by first, in S4, selecting the (i−n)nth dot row, reading dot data for odd-number dots, and sending the dot data to the head driver 28 and then, in S5, selecting the (i)th, reading the dot data for the even-number dots, and sending the dot data to the head driver 29. Further, when the nozzle row pitch L is set in this fashion, then control for printing subsequent dot rows is easily performed by repeating S4 through S7 every time n pulses of the pulse signal from the encoder are detected in S3.

While the invention has been described in detail with reference to specific embodiments thereof, it would be apparent to those skilled in the art that various changes and modifications may be made therein without departing from the spirit of the invention, the scope of which is defined by the attached claims.

For example, the invention was described above applied to the ink jet head wherein its first row of odd-number nozzles and its second row of even-number nozzles are shifted in the direction in which the of the nozzle rows extend, so that the nozzles of each nozzle row are staggered. Instead a plurality of nozzle rows can aligned without shifting the nozzles in the rows.

Although the above-described embodiment describes the present invention applied to the ink jet head, which ejects ink droplets to print, the present invention could be applied to any other type of print head using elements aligned in rows to print an image. For example, the present invention could be applied to a direct printing head with toner, the head having aligned elements for printing images with toner particles.

The movement amount of the portable dot printing device according to the present invention can be detected by other means than the encoder 10. For example, the position detection means need not contact the recording medium 13 to perform this task. For example, by using a non-contact speed and position detection means, such as a laser Doppler speed and position detector, the relative speed and position between the portable dot printing device and the recording medium can be detected. Further, the casing of the portable dot printing device can be supported in other ways than by the roller 4 and the lower portion 11*a*. For example, a roller not connected to the encoder can be provided for supporting the portable dot printing device. Alternatively, the lower portion 11*a* by itself or another similar protrusion formed from a resin or a similar material with good sliding characteristics with respect to the printing sheet 13 would be sufficient for supporting the portable dot printing device.

In summary, as described above the nozzle row pitch of the print head is set equal to a multiple of the minimum movement amount detectable by the encoder. Therefore, the nozzle rows are able to print accurately and precisely at desired positions.

Because the nozzle row pitch of the print head is set based on a multiple of the angular interval between slits in the slit disk, a portion to be printed by the nozzle row of the print head can be precisely detected.

Because the nozzle rows of the print head include first and second rows having odd-number nozzles and even-number nozzles respectively, and because the nozzles in the first and the second rows are shifted in the direction in which the nozzle rows extend, high density printing can be performed.

What is claimed is:

1. A portable dot printing device for printing dot images on a recording medium, the portable dot printing device comprising:

a movement amount detection means for detecting movement amount of the portable dot printing device across the recording medium and for producing a pulse signal based on a fixed predetermined detectable movement amount, said fixed predetermined detectable movement amount being the smallest movement amount detectable by the movement amount detection means as the movement amount detection means moves across the recording medium;

a print head formed with at least a first element row and a second element row each having elements for printing dots on the recording medium, the first element row and the second element row being separated by a fixed predetermined distance equal to a distance obtained by multiplying the fixed predetermined detectable movement amount and a single predetermined fixed integer, the print head being controlled to print images using the elements based on the pulse signal from the movement amount detection means; and a control device that controls the print head so that the elements in both the first and second element rows print dots simultaneously and that, in synchronization with the pulse signal from the movement amount detection means, controls the elements of the first and second element rows to print dots;

wherein as the portable dot printing device is moved across the recording medium, the movement amount detection means produces the pulse signal synchronously with the portable dot printing device being moved a distance equal to the fixed predetermined detectable movement amount.

2. A portable dot printing device as claimed in claim 1, wherein the movement amount detection means includes:

a slit disk rotating in association with movement of the print head across the recording medium and formed with a plurality of slits extending radially from a center of the slit disk at an equiangular interval; and a photointerupter for emitting light and detecting light passing through the slits of the slit disk, each pulse of the pulse signal corresponding to detection of light passing through one of the slits;

and wherein the predetermined pitch between the first element row and the second element row is equal to a multiple of the angular interval between the slits of the slit disk.

3. A portable dot printing device as claimed in claim 2, wherein the first element row and the second element row extend parallel with each other in a direction.

4. A portable dot printing device as claimed in claim 3, wherein elements of the first element row and elements of the second element row are shifted from each other in the direction in which the first element row and the second element row extend.

5. A portable dot printing device as claimed in claim 4, wherein the multiple is a product of the detechable movement amount and an integral number, and further comprising a control device for detecting pulses of the pulse signal from the movement amount detection means and controlling the print head to print using the first element row and then, after detecting a number of pulses equal to the integral number, controlling the print head to print using the second element row.

6. A portable dot printing device as claimed in claim 2, further comprising:

a support frame disposed adjacent to the print head;

a roller rotatably supported by the support frame and for rotating across the printing medium during printing, the roller and the slit disk being connected so that the slit disk rotates in association with rotation of the roller.

7. A portable dot printing device as claimed in claim 1, wherein the first element row and the second element row extend parallel with each other in a direction.

8. A portable dot printing device as claimed in claim 7, wherein elements of the first element row and elements of the second element row are shifted from each other in the direction in which the first element row and the second element row extend.

9. A portable dot printing device as claimed in claim 8, wherein the multiple is a product of the detechable movement amount and an integral number, and further comprising a control device for detecting pulses of the pulse signal from the movement amount detection means and controlling the print head to print using the first element row and then, after detecting a number of pulses equal to the integral number, controlling the print head to print using the second element row.

10. A portable dot printing device as claimed in claim 1, wherein the multiple is a product of the detechable movement amount and an integral number, and further comprising a control device for detecting pulses of the pulse signal from the movement amount detection means and controlling the print head to print using the first element row and then, after detecting a number of pulses equal to the integral number, controlling the print head to print using the second element row.

11. A portable dot printing device as claimed in claim 1, wherein the portable dot printing device is scanned in a scanning direction across a surface of the recording medium during printing and further comprising:

positioning means provided at a front side of the print head with respect to the scanning direction and having a contact portion for positioning the print head with respect to the surface of the recording medium by contacting the surface of the recording medium.

12. A portable dot printing device as claimed in claim 11, further comprising a roller for rotating over the surface of the recording medium to detect relative position between the recording medium and the print head.

13. A portable dot printing device as claimed in claim 11, wherein the positioning means includes a support means for maintaining a predetermined posture of the portable dot printing device with respect to the surface of the printing medium.

14. A portable dot printing device as claimed in claim 1, wherein the elements are nozzles for ejecting ink droplets.

15. A portable dot printing device as claimed in claim 1, wherein the elements are for forming an image on the recording medium using toner particles.

16. A method of controlling a portable dot printing device for printing dot images on a recording medium, the method comprising the steps of:

detecting with a movement amount detection means movement amount of the portable dot printing device across the recording medium;

producing a pulse signal based on a fixed predetermined detectable movement amount, said fixed predetermined detectable movement amount being the smallest movement amount detectable by the movement amount detection means as the movement amount detection means moves across the recording medium, the pulse signal produced synchronously with the portable dot printing device being moved a distance equal to the fixed predetermined detectable movement amount; and controlling a print head, which is formed with at least a first element row and a second element row each having elements for printing dots on the recording medium, wherein the first element row and the second element row are separated by a fixed predetermined distance equal to a distance obtained by multiplying the fixed predetermined detectable movement amount and a single predetermined fixed integer, to print images using the elements based on the pulse signal.

17. A method as claimed in claim 16, wherein the multiple is a product of the detechable movement amount and an integral number, and the step of controlling the print head includes the steps of:

detecting pulses of the pulse signal from the movement amount detection means;

controlling the print head to print using the first element row;

detecting a number of pulses equal to the integral number; and controlling the print head to print using the second element row.

18. A portable dot printing device for printing dot images on a surface of a recording medium when manually scanned in a scanning direction over the recording medium, the portable dot printing device comprising:

an elongated body to be manually grasped by a user and having an upper tip and a lower tip opposite the upper tip, the lower tip confronting the recording medium when the body is oriented with respect to the recording medium to print on the recording medium;

a roller rotatably supported to rotate across the surface of the recording medium when the portable dot printing device is scanned in the scanning direction over the recording medium;

a slit disposed in the body and connected to rotate in association with the roller, the slit disk being formed with a plurality of slits extending radially from a center of the slit disk at a fixed predetermined equiangular interval;

a photointerupter for emitting light and detecting light passing through the slits of the slit disk and for outputting a pulse signal synchronously with detection of light passing through the slits of the slit disk as the portable dot printing device is moved on the surface of the recording medium;

a print head disposed at the lower tip and formed with at least a first nozzle row and a second nozzle row each having nozzles for printing dots on the recording medium, the first nozzle row and the second nozzle row being separated by a fixed predetermined distance equal to a distance obtained by multiplying the fixed predetermined equiangular interval and a single predetermined fixed integer; and a control unit for controlling the print head to eject ink droplets from the nozzles based on the pulse signal from the photointerupter.

19. A portable dot printing device as claimed in claim 18, wherein the first nozzle row and the second nozzle row extend parallel with each other in a direction.

20. A portable dot printing device as claimed in claim 19, wherein elements of the first nozzle row and elements of the second nozzle row are shifted from each other in the direction in which the first nozzle row and the second nozzle row extend.

21. A portable dot printing device as claimed in claim 18, further comprising:

a frame for rotatably supporting the roller disposed at the lower tip and, with respect to the scanning direction, in front of the print head; and a protrusion including a contact portion extending from the frame and, when the body is oriented to print on the recording medium, into contact with the recording medium so as to maintain a predetermined distance between the print head and the recording medium.

22. A portable dot printing device as claimed in claim 21, wherein the contact portion also maintains a predetermined upright orientation of the body.

* * * * *